US005816588A

United States Patent [19]

Nicoletti

[11] Patent Number: 5,816,588

[45] Date of Patent: Oct. 6, 1998

[54] CARRIER FOR AN IN-LINE ROLLER SKATE

[75] Inventor: Graziano Nicoletti, Treviso, Italy

[73] Assignee: Bauer Italia S.p.A., Treviso, Italy

[21] Appl. No.: 869,001

[22] Filed: Jun. 4, 1997

[51] Int. Cl.[6] ..... A63C 17/02

[52] U.S. Cl. ..... 280/11.22; 280/11.19; 280/11.27; 280/11.28

[58] Field of Search ..... 280/11.22, 11.23, 280/11.28, 11.19, 11.26, 690–124.164, 701–124.179, 11.27

[56] References Cited

U.S. PATENT DOCUMENTS

| | | | |
|---|---|---|---|
| 307,840 | 11/1884 | Burton | 280/11.28 |
| 311,936 | 2/1885 | Wisewell | 280/11.28 |
| 1,745,992 | 2/1930 | Herold | 280/11.28 |
| 2,738,542 | 3/1956 | Clark | 280/725 |
| 2,885,720 | 5/1959 | Seeberger | 16/44 |
| 3,287,023 | 11/1966 | Ware | 280/11.2 |
| 4,000,912 | 1/1977 | Donald et al. | 280/701 |
| 5,280,931 | 1/1994 | Horton | 280/11.22 |
| 5,390,958 | 2/1995 | Soo | 280/11.28 |
| 5,690,344 | 11/1997 | Chen | 280/11.27 |
| 5,704,621 | 1/1998 | Lazarevich | 280/11.28 |

FOREIGN PATENT DOCUMENTS

| | | | |
|---|---|---|---|
| 2399 | 6/1876 | United Kingdom | 280/11.27 |

*Primary Examiner*—Brian L. Johnson
*Assistant Examiner*—Michael Cuff
*Attorney, Agent, or Firm*—Sughrue, Mion, Zinn, Macpeak & Seas, PLLC

[57] ABSTRACT

A carrier for an in-line roller skate comprises an elongate body (8) which is to support a series of wheels (5) which are aligned with one another and have respective axes (9) parallel to and spaced from one another. The carrier (3) includes removable suspension means (13) which are interposed between the elongate body (8) and each of the wheels (5) and which can be fastened to the elongate body (8) in a plurality of predetermined positions (15) in order to permit variation in the distance between the wheels (5).

10 Claims, 4 Drawing Sheets

CARRIER FOR AN IN-LINE ROLLER SKATE

BACKGROUND OF THE INVENTION

The present invention relates to in-line roller skates and, especially, to a carrier for such a skate, comprising an elongate body which is to support a series of wheels which are aligned with one another and have respective axes parallel to and spaced from one another.

The known skates of the type defined above are generally produced as illustrated diagrammatically in the appended FIG. 1, in such a manner as to comprise a carrier 3 which supports the wheels 5 and to which a shoe 7 is fastened or fastenable.

In particular, the carrier 3 has an elongate half-shell-shaped main body 8 which is open at the bottom and defines a groove which extends longitudinally relative to the shoe 7. The carrier 3 carries a plurality of transverse pins 9, which are spaced from one another longitudinally by a constant centre to centre distance and on each of which a respective wheel 5 is mounted for rotation.

A brake pad 11 of rubber or similar material is generally arranged at the rear end of the carrier 3.

Skates of the known type defined above have, however, the disadvantage of being poorly suited to the accommodation of wheels having a different diameter from that of the wheels initially supplied by the manufacturer. It may be necessary to replace the originally provided wheels by others having a different diameter in order to adapt the skates to a particular ground surface, for example, when the skates are to be used on tracks for high-speed racing or for jumping or on an asphalt road surface. The fact that, for a given type of skate, the centre to centre distance between the wheels is normally fixed limits the possibility of using, if required, wheels having a substantially larger diameter than that of the wheels originally supplied.

SUMMARY OF THE INVENTION

In order to overcome this disadvantage, the invention relates to a skate of the type indicated above, characterized in that it includes removable suspension means interposed between the elongate body and each of the wheels, the suspension means being fastenable to the elongate body in a plurality of predetermined positions in order to permit variation in the distance between the wheels.

Owing to those characteristics, the carrier according to the invention readily permits the use of wheels having a different diameter as a function of the surface on which it is intended to use the skates. The carrier is also reliable, has a simple structure and is economical to produce.

Preferably, the suspension means comprise a fork for each wheel, which fork has a pair of symmetrical arms inclined relative to the elongate body of the carrier so that the forks can be mounted in such a manner as to vary the size of the contact area of the skate with the ground or to modify the relative position of the centre of the area of contact between the skate and the ground relative to the shoe associated with the skate.

Damping means are advantageously associated with the suspension means in order to damp the bumps to which the user is subjected when using the skates on uneven ground or as a result of performing jumps, which is advantageous for comfort.

BRIEF DESCRIPTION OF THE DRAWINGS

Other characteristics and advantages of the invention will become clear from the following detailed description given with reference to the appended drawings which are provided purely by way of non-limiting example and in which.

DETAILED DESCRIPTION OF THE INVENTION

Figure 1:
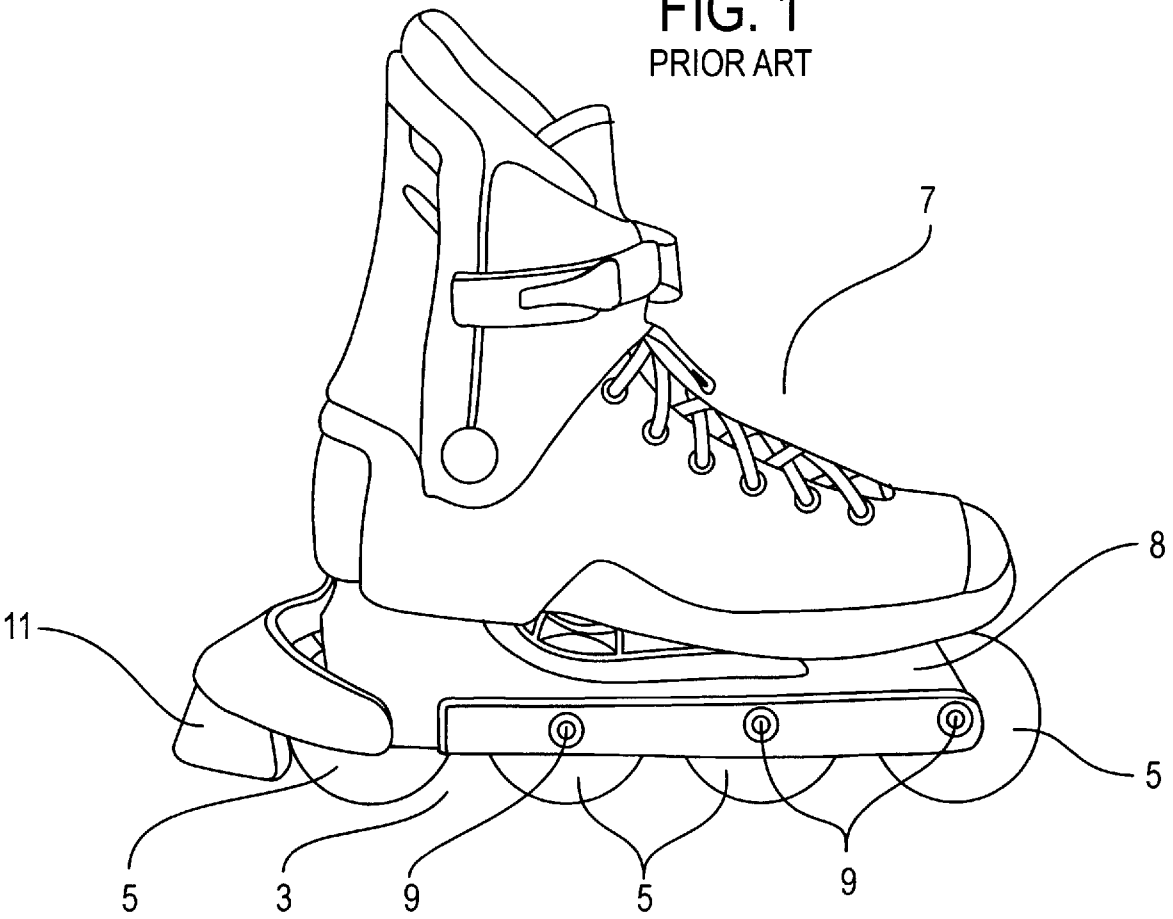
FIG. 1 PRIOR ART
FIG. 1 is a diagrammatic perspective view of an in-line roller skate according to the prior art.
Figure 2:
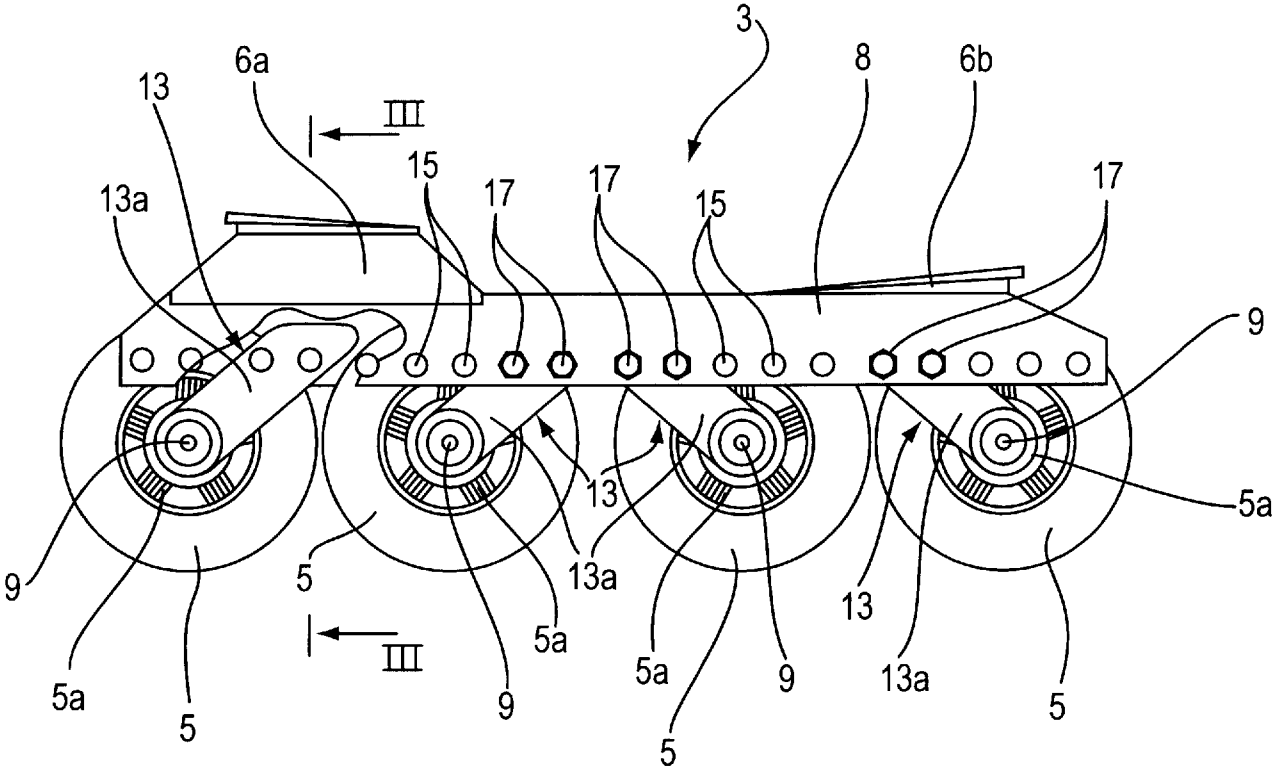
FIG. 2 is a partially sectioned lateral elevation of a carrier for an in-line roller skate according to the invention.
Figure 3:
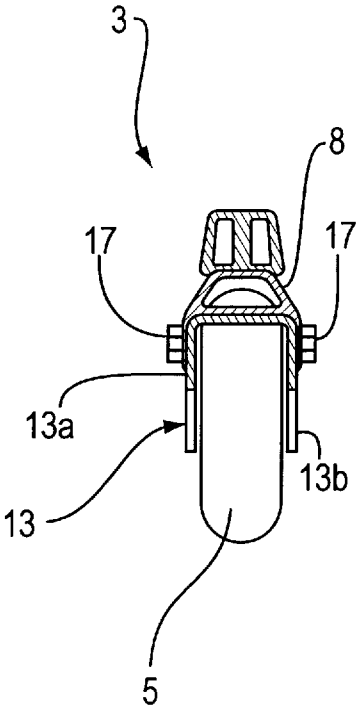
FIG. 3 is an elevation sectioned along the line III—III of FIG. 2, FIGS. 4 and 6 are views similar to FIG. 2 of variants of the present invention.
Figure 4:
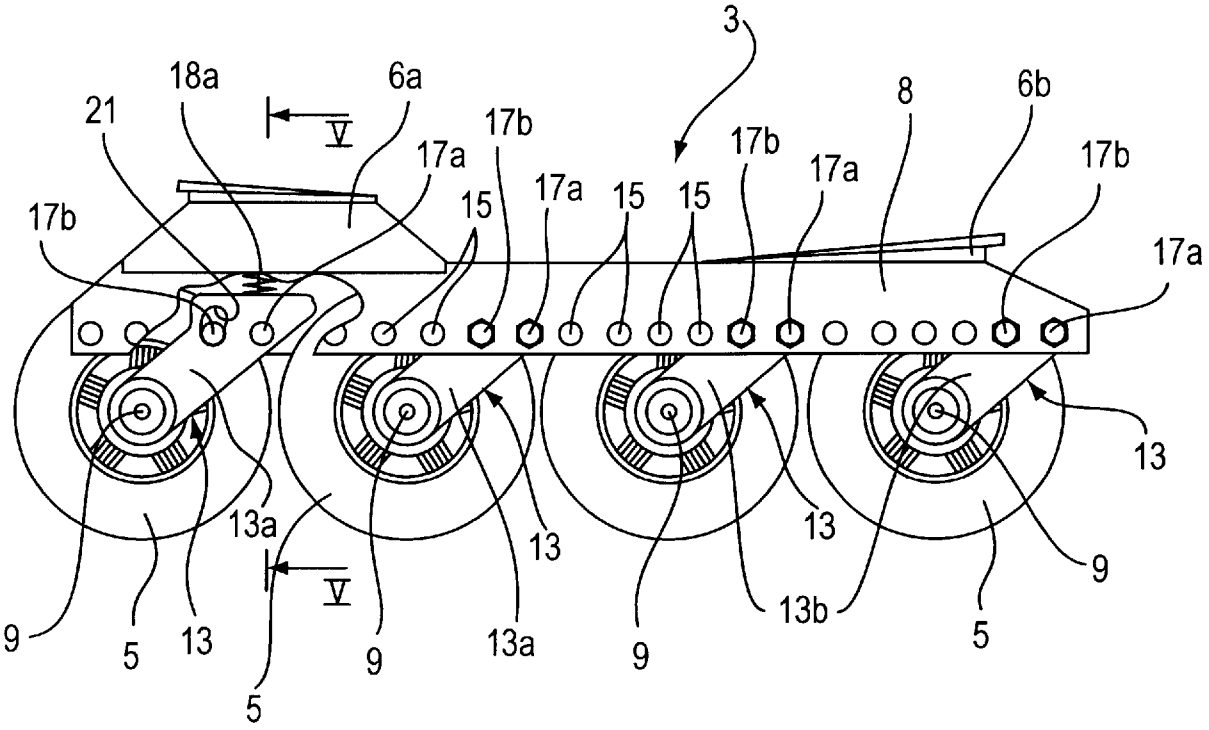
Figure 5:
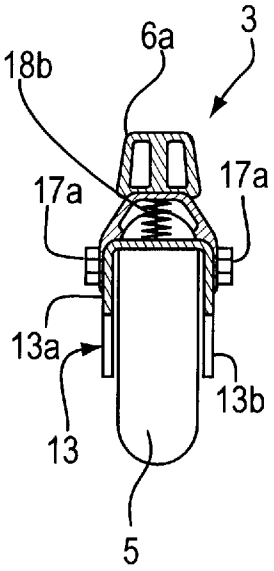
FIGS. 5 and 7 are views similar to FIG. 3 which are sectioned, respectively, along the line V—V of FIG. 4 and along the line VII—VII of FIG. 6.
Figure 6:
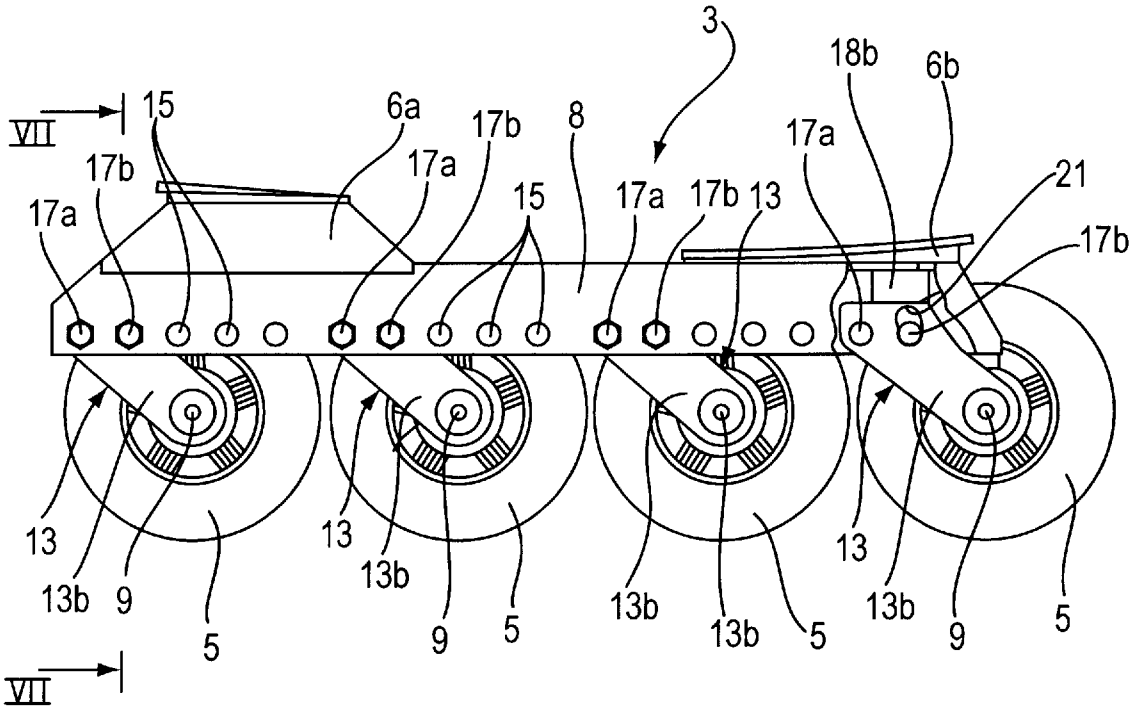
Figure 7:
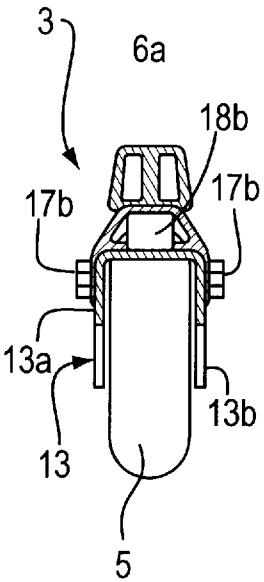

Referring to FIGS. 2 to 1, in which the same reference numerals have been used to indicate elements which are the same as or similar to those in FIG. 1, an in-line roller skate comprises a carrier 3 formed by an elongate body 8 produced, for example, by moulding plastics material or using a portion of a profiled section formed by a plastics or metal extrusion process.

The carrier 3 is intended especially to support, at the bottom, a series of aligned wheels 5 which are rotatable about respective axes of rotation 9 parallel to and spaced from one another and which are generally provided with associated ball bearings. The carrier 3 is to carry, at the top, a shoe (not shown in FIGS. 2 to 7) which can be produced in one piece with the body 8 or which can be fastened thereto in a manner known per se in the area of a pair of attachment plates 6*a* and 6*b*, at the rear and the front, respectively.

Because they do not fall within the scope of the invention and for the sake of clarity in the drawings, no brake pads have been shown in the Figures.

The elongate body 8 has a pair of symmetrical side cheeks having a series of holes 15, for example, aligned longitudinally, which define a plurality of predetermined positions for the connection of suspension means for each of the wheels 5.

Those suspension means are preferably produced with fork elements 13, each of which has a pair of arms 13*a*, 13*b*, which, in the mounted state, are inclined relative to the axis of the body 8.

The forks 13 can thus be connected to the body 8 at a plurality of positions by means of connecting elements of a type known per se, for example bolts 17, which engage in the holes 15 and in corresponding holes formed in the forks 13. It is thus possible to vary the centre to centre distance between the wheels 5 in order to be able to use wheels 5 of different diameters.

In addition, owing to the inclination of the arms 13*a*, 13*b*, it is possible to mount the forks 13 with the associated arms all facing forwards or all facing backwards or, in accordance with other combinations, with some arms facing forwards and other arms facing backwards as illustrated in FIG. 2, in order to modify the longitudinal size of the contact area of the skate 1 with the ground or to vary the relative position of the centre of the area of contact between the skate and the ground relative to the shoe associated with the skate.

According to two variants of the invention illustrated in FIGS. 4, 5 and 6, 7, respectively, which show a carrier according to the invention in which the arms of all of the forks 13 face backwards or forwards, respectively, the forks 13 are mounted so that they can oscillate relative to the body

8, and damping means are interposed between the body 8 and each fork 13.

Each fork 13 is especially articulated in the area of a pair of holes 15, formed symmetrically on the opposing cheeks of the body 8, by means of a pair of first aligned pins 17*a* which define the oscillation axis thereof. A second pair of pins 17*b*, which are also aligned and engage in a pair of symmetrical holes 15 in the body 8, in their turn engage slidably in a pair of curved guide slots 21 concentric with the adjacent pin 17*a* associated with the cheek of the body 8, the radius of which curved guide slots 21 corresponds to the distance between two successive holes 15. The opposing ends of each slot 21 define stop abutments for limiting the sliding of the bolts 17*b* along the slot so that the maximum extent of oscillation of the forks 13 is defined.

The damping means may be constituted by any resilient and/or damping device of a type known per se, especially a helical spring 18*a* (FIGS. 4 and 5) or by a pad of resiliently deformable material 18*b* (FIGS. 6 and 7), for example elastomeric material, associated with each fork 13. In that case, auxiliary reference means can be provided to hold the damping means in a predetermined position relative to the body 8 and to each fork 13.

What is claimed is:

1. A carrier for an in-line roller skate, comprising an elongate body (8) which is to support a series of wheels (5) which are aligned with one another and have respective axes (9) parallel to and spaced from one another, characterised in that the carrier includes a plurality of removable suspension means (13) interposed between the elongate body (8) and each of the wheels (5), respectively, for rotatable supporting each of the wheels, each suspension means (13) being fastened to the elongate body (8) in a plurality of predetermined positions (15) by first and second parallel pins spaced from each wheel axis in order to permit variation in the distance between the wheels (5).

2. A carrier according to claim 1, characterised in that the suspension means comprise a fork (13) for each wheel (5).

3. A carrier according to claim 2, characterised in that the elongate body (8) has, on its sides, a series of holes (15) engageable by said first and second parallel pins in order to connect each fork (13) to the elongate body (8).

4. A carrier according to claim 2, characterised in that each fork (13) has a pair of symmetrical arms (13*a*, 13*b*) inclined relative to the elongate body (8) of the carrier (3).

5. A carrier according to claim 1, characterised in that damping means are associated with the suspension means (13).

6. A carrier according to claim 5, characterised in that each fork (13) is connected to the elongate body (8) by means of said first pin (17*a*) defining an axis of rotation of the fork (13) and said second pin (17*b*) slidable within a curved guide slot (21) concentric with the first pin 17*a*, whereby the fork (13) is oscillatable about the first pin (17*a*) between a pair of end positions defined by the opposing ends of the guide slot (21).

7. A carrier according to claim 6, characterised in that the damping means comprise a resilient device (19*a*; 19*b*) interposed between each fork and the elongate body.

8. A carrier according to claim 7, characterised in that the resilient device is a helical spring (18*a*).

9. A carrier according to claim 7, characterised in that the resilient device is a pad of resiliently deformable material (18*b*).

10. An in-line roller skate, characterised in that it comprises a carrier (3) according to claim 1.

* * * * *